US010729226B1

(12) United States Patent
Zamora

(10) Patent No.: US 10,729,226 B1
(45) Date of Patent: Aug. 4, 2020

(54) SUPPORT STAND FOR HOLDING ARTICLES

(71) Applicant: Janet Zamora, Ft Lauderdale, FL (US)

(72) Inventor: Janet Zamora, Ft Lauderdale, FL (US)

( * ) Notice: Subject to any disclaimer, the term of this patent is extended or adjusted under 35 U.S.C. 154(b) by 0 days.

(21) Appl. No.: 16/507,484

(22) Filed: Jul. 10, 2019

(51) Int. Cl.
*A45F 3/44* (2006.01)

(52) U.S. Cl.
CPC ..... *A45F 3/44* (2013.01); *A45F 2200/05* (2013.01)

(58) Field of Classification Search
CPC ..... A45F 3/44; A45F 2200/05; A47F 5/04; A47F 5/06
USPC ..... 211/196
See application file for complete search history.

(56) References Cited

U.S. PATENT DOCUMENTS 963,893 A * 7/1910 Hegarty ..... A47F 5/06 211/172
983,392 A * 2/1911 Nielsen ..... A47F 5/04 248/159
1,038,198 A * 9/1912 Randall et al. ..... A47F 5/04 211/205
1,525,701 A * 2/1925 Rose ..... A47G 25/0664 211/196
3,076,557 A * 2/1963 Husted ..... A45F 3/44 211/196
4,447,847 A * 5/1984 Drulard ..... E04H 12/2215 361/117
4,453,640 A * 6/1984 Cillario ..... A47F 5/13 211/133.4
4,832,304 A * 5/1989 Morgulis ..... A01K 97/10 135/16
5,046,699 A * 9/1991 Perreault ..... E04H 12/2223 135/16
5,161,561 A * 11/1992 Jamieson ..... A45B 3/00 108/94
5,318,175 A * 6/1994 Stevens ..... A47G 25/0664 211/107
5,318,189 A * 6/1994 Lee ..... A47G 25/0664 211/196
5,862,924 A * 1/1999 Dumont ..... A47F 5/04 211/118
6,487,977 B1 * 12/2002 Williams ..... A45B 23/00 108/150

(Continued)

FOREIGN PATENT DOCUMENTS

GB 528262 A * 10/1940 ..... A45F 3/44

*Primary Examiner* — Stanton L Krycinski
(74) *Attorney, Agent, or Firm* — Sanchelima & Associates, P.A.; Christian Sanchelima; Jesus Sanchelima

(57) ABSTRACT

A support stand for hanging articles is disclosed herein. The support stand comprises an elongated tube having a threaded portion. The support stand further comprises a first post mounted to the elongated tube having first arms mounted diagonally to the first post. The support stand additionally comprises a second post insertable in the first post having post extensions mounted perpendicularly to the second post and second arms mounted diagonally to the second post. The support stand further comprises a third post insertable in the second post having hook members mounted perpendicularly to the third post, and third arms mounted diagonally to the third post. The elongated tube is inserted in a sand environment. Articles are made to hold at one of the first arms, the post extensions, the second arms, the hook members and the third arms.

6 Claims, 4 Drawing Sheets

(56) References Cited

U.S. PATENT DOCUMENTS

| | | | | |
|---|---|---|---|---|
| 6,675,819 | B2 * | 1/2004 | Arrowood | A45F 3/44 135/118 |
| 6,702,129 | B1 * | 3/2004 | Harris | A47G 25/0664 211/172 |
| 6,715,503 | B2 * | 4/2004 | Brooks, III | A45B 3/00 135/16 |
| 6,732,985 | B1 | 5/2004 | Cantrell | |
| 6,925,754 | B1 * | 8/2005 | Tearoe | A01G 9/12 172/371 |
| 7,458,475 | B2 * | 12/2008 | Ho | A47G 7/041 211/182 |
| 7,857,279 | B2 * | 12/2010 | Krasnicki | A45F 3/44 124/86 |
| 7,950,085 | B2 * | 5/2011 | McGovern | A45F 3/44 294/57 |
| 8,191,561 | B2 * | 6/2012 | Brooks, III | E04H 12/2223 135/16 |
| 8,240,488 | B2 * | 8/2012 | Huang | B05B 13/0292 211/107 |
| 9,554,630 | B1 * | 1/2017 | Patel | A45B 25/02 |
| 10,244,852 | B1 * | 4/2019 | Donaldson | A45F 4/00 |
| 2006/0186073 | A1 * | 8/2006 | Roe | D06F 59/02 211/196 |
| 2009/0278020 | A1 * | 11/2009 | Marcil | A45F 3/44 248/545 |
| 2017/0215562 | A1 * | 8/2017 | Williams | A45F 3/44 |
| 2019/0070472 | A1 * | 3/2019 | Duran | A47G 25/0685 |

* cited by examiner

SUPPORT STAND FOR HOLDING ARTICLES

BACKGROUND OF THE INVENTION

1. Field of the Invention

The present invention generally relates to stands used for hanging articles. More specifically, the present invention relates to a support stand used in a sand environment or on a flat surface for holding or hanging articles such as clothing articles.

2. Description of the Related Art

It is known that many people enjoy going to a beach to enjoy the sun, sand and surf. Further, people do enjoy going on picnic, a pool and so on. As known, several items such as beach towels, handbags, caps, umbrellas, clothing articles and so on are carried to the beach and/or pools for variety of reasons. Although the activities that can be performed in the beach and/or pools are fun, the people need to organize the items that are carried with them. Generally, there are no structures available at the beach for the people to hang the items.

Several stands or poles are used in the past that can be used to hang articles such as clothing articles, cups and so on. One such example is disclosed in a U.S. Pat. No. 6,732,985. In U.S. Pat. No. 6,732,985B1, it is disclosed a multi-segmented central post member with upper, middle, and lower sections having a cup-holding element, a utility member and a clothes-hanging element having a plurality of hook members extending therefrom. Although the reference discussed is capable of holding articles such as clothes, umbrella and other items, they have few disadvantages. For example, they are not easy to install and remove. Further, the stands or posts discussed above cannot be used to hang many items at once. Additionally, they are not suitable to erect in a sand environment such as a beach. The present invention addresses these issues by providing a support stand for hanging articles that is adapted to function in a sand environment. The support stand further includes a first, second, and third post having attachable arms for holding clothing articles.

Other documents describing the closest subject matter provide for a number of more or less complicated features that fail to solve the problem in an efficient and economical way. None of these patents suggest the novel features of the present invention. Specifically, none of the disclosures in the art disclose a support stand that can be used in a sand environment or on a flat surface for holding or hanging multiple articles at once. Further, none of the above disclosures disclose a support stand that is easy to install and remove from the sand environment.

SUMMARY OF THE INVENTION

It is one of the objects of the present invention to provide a support stand that can be used in a sand environment for hanging articles and that avoids the drawbacks of the prior art.

It is one object of the present invention to provide a support stand that is easy to install and remove from the sand environment.

It is one object of the present invention to provide a support stand that allows adjusting height so that the support stand can be mounted at various places.

It is one object of the present invention to provide a support stand allowing hanging of articles of various shape and size.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

Various features and embodiments of a support stand for hanging articles are explained in conjunction with the description of FIGS. 1-4.

Figure 1:
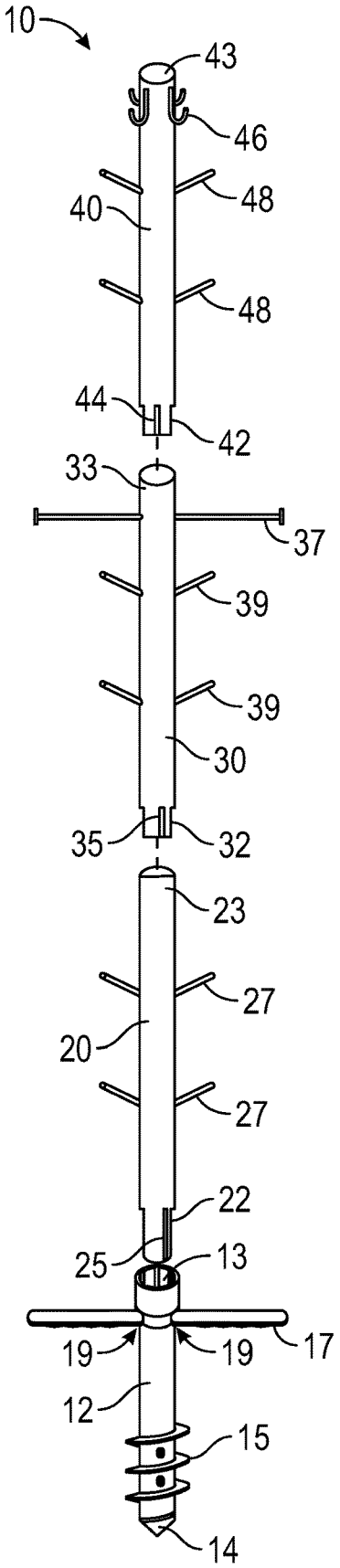
FIG. 1 illustrates an exploded view of a support stand 10, in accordance with one embodiment of the present invention.

Referring to FIG. 1, an exploded view of a support stand 10 is shown, in accordance with one embodiment of the present invention. The support stand 10 comprises an elongated tube 12. The elongated tube 12 might be made up of metal, hard plastic or any other material. At one end, the elongated tube 12 might be provided with an opening 13 and another end might be provided with a tapered portion 14. Further, the elongated tube 12 might be provided with a threaded portion 15. Further, the elongated tube 12 may further comprise a support plate 17 hingedly mounted to the elongated tube 12. As can be seen from FIG. 1, the support plate 17 is mounted perpendicularly to the elongated tube 12. In one example, the support plate 17 is mounted with the help of hinges 19.

The support stand 10 comprises a first post 20. The first post 20 may indicate an elongated pole or tube made up of metal, plastic or any other material. The first post 20 might be provided as a solid structure or as a hollow structure i.e., a hollow tube. Preferably, the first post 20 is provided in hollow structure. The first post 20 comprises a first end 22 and a second end 23. The first end 22 might indicate a bottom end and the second end 23 might indicate a top end of the first post 20.

It should be understood that diameter of the first end 22 is less than the diameter of the first post 20. Further, at the first end 22, a plurality of first ridges 25 are provided. Further, the support stand 10 comprises first arms 27 mounted to the first post 20. The first arms 27 might be removably or permanently mounted to the first post 20 using known mechanisms such as fasteners, adhesives, welding or any other mechanism. The first arms 27 might indicate first accessory units that are used to hang or hold articles. The first arms 27 might be mounted to the first post 20 either perpendicularly or diagonally. In the current embodiment, the first arms 27 are mounted to the first post 20 in diagonal configuration. However, a person skilled in the art will appreciate that the first arms 27 may be mounted to the first post 20 in a perpendicular or any other configuration.

The support stand 10 further comprises a second post 30. The second post 30 may indicate an elongated pole or tube made up of metal, plastic or any other material. The second post 30 might be provided as a solid structure or as a hollow structure i.e., a hollow tube. Preferably, the second post 30 is provided in hollow structure. The second post 30 comprises a third end 32 and a fourth end 33. The third end 32 might indicate a bottom end and the fourth end 33 might indicate a top end of the first post 20. It should be understood that diameter of the third end 32 is less than the diameter of the first post 20. Further, at the third end 32, a plurality of second ridges 35 are provided. Further, the second post 30 comprises post extensions 37 provided in proximity to the fourth end 33. The post extensions 37 might be made up of metal, plastic or any other material. The post extensions 37 might be removably or permanently mounted to the second post 30 using known mechanisms such as fasteners, adhesives, welding or any other mechanism. The post extensions 37 are provided at desired length so as to hang multiple articles at the fourth end 33 of the second post 30. In one example, the post extensions 37 are mounted perpendicularly to the second post 30.

Further, the support stand 10 comprises second arms 39 mounted to the second post 30. The second arms 39 might be removably or permanently mounted to the second post 30 using known mechanisms such as fasteners, adhesives, welding or any other mechanism. The second arms 39 might indicate first accessory units that are used to hang or hold articles. The second arms 39 might be mounted to the second post 30 either perpendicularly or diagonally. In the current embodiment, the second arms 39 are mounted to the second post 30 in diagonal configuration. However, a person skilled in the art will appreciate that the second arms 39 may be mounted to the second post 20 in a perpendicular or any other configuration. Additionally, second arms 29 may be mounted to other posts in another embodiment of the present invention.

The support stand 10 further comprises a third post 40. The third post 40 may indicate an elongated pole or tube made up of metal, plastic or any other material. The third post 40 might be provided in a solid structure or a hollow structure i.e., a hollow tube. The third post 40 comprises a fifth end 42 and a sixth end 43. The fifth end 42 might indicate a bottom end of the third post 40 and the sixth end 43 might indicate a top end of the third post 40. It should be understood that diameter of the fifth end 42 is less than the diameter of the third post 40. Further, at the fifth end 42, a plurality of third ridges 44 are provided.

At the sixth end 43, the third post 40 is provided with hook members 46. The hook members 46 might be made up of plastic, ceramic, metal or any other material. The hook members 46 might be removably or permanently mounted to the second post 40 using known mechanisms such as fasteners, adhesives, welding or any other mechanism. Further, the support stand 10 comprises third arms 48 mounted to the second post 40. The third arms 48 might be plastic, ceramic, metal or any other material. The third arms 48 might be removably or permanently mounted to the third post 40 using known mechanisms such as fasteners, adhesives, welding or any other mechanism. The third arms 48 might indicate second accessory units that are used to hang or hold articles. The third arms 48 might be mounted to the third post 40 either perpendicularly or diagonally. In the current embodiment, the third arms 48 are mounted to the third post 40 in diagonal configuration. However, a person skilled in the art will appreciate that the third arms 48 may be mounted to the third post 40 in a perpendicular or any other configuration.

Figure 2:
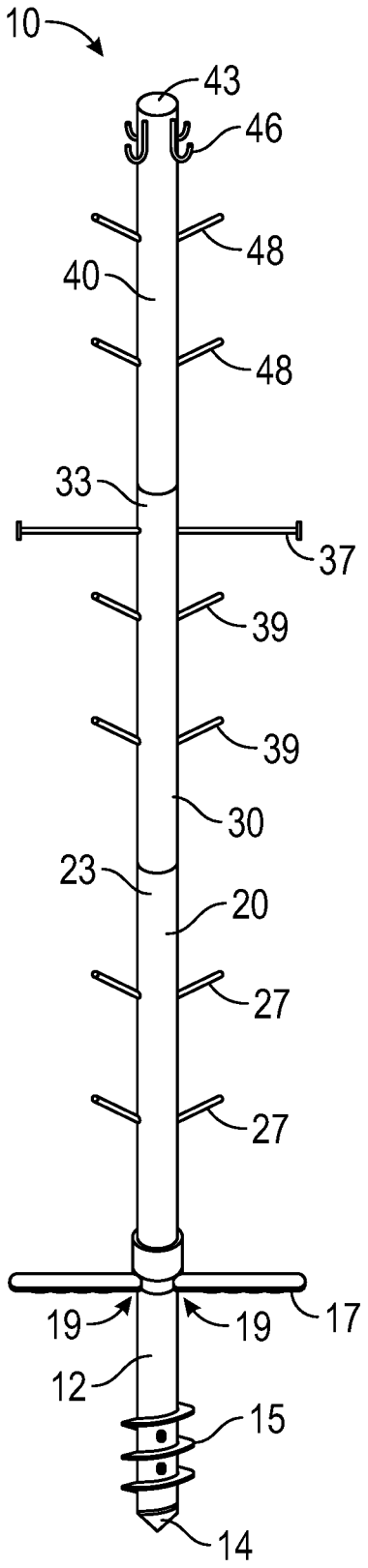
FIG. 2 illustrates a perspective view of the support stand 10, in accordance with one embodiment of the present invention.

Now referring to FIG. 2, the first post 20 mounted to the elongated tube 12, the second post 30 mounted to the first post 20, and the third post 40 mounted to the second post 30 is shown, in accordance with one embodiment of the present invention. It should be understood that the first end 22 of the first post 20 is inserted into the elongated tube 12 through the opening 13 of the elongated tube 12. Due to the presence of the first ridges 25 at the first end 22, it is ensured that the first post 20 is firmly mounted to the elongated tube 12. Similarly, the third end 32 of the second post 30 is inserted into the second end 23 of the first post 20. Due to the presence of the second ridges 35 at the third end 32, it is ensured that the second post 30 is firmly mounted to the first post 20. Further, the fifth end 42 of the third post 40 is inserted into the fourth end 24 of the second post 30. Due to the presence of the third ridges 44 at the fifth end 42, it is ensured that the third post 40 is firmly mounted to the second post 30.

Figure 3:
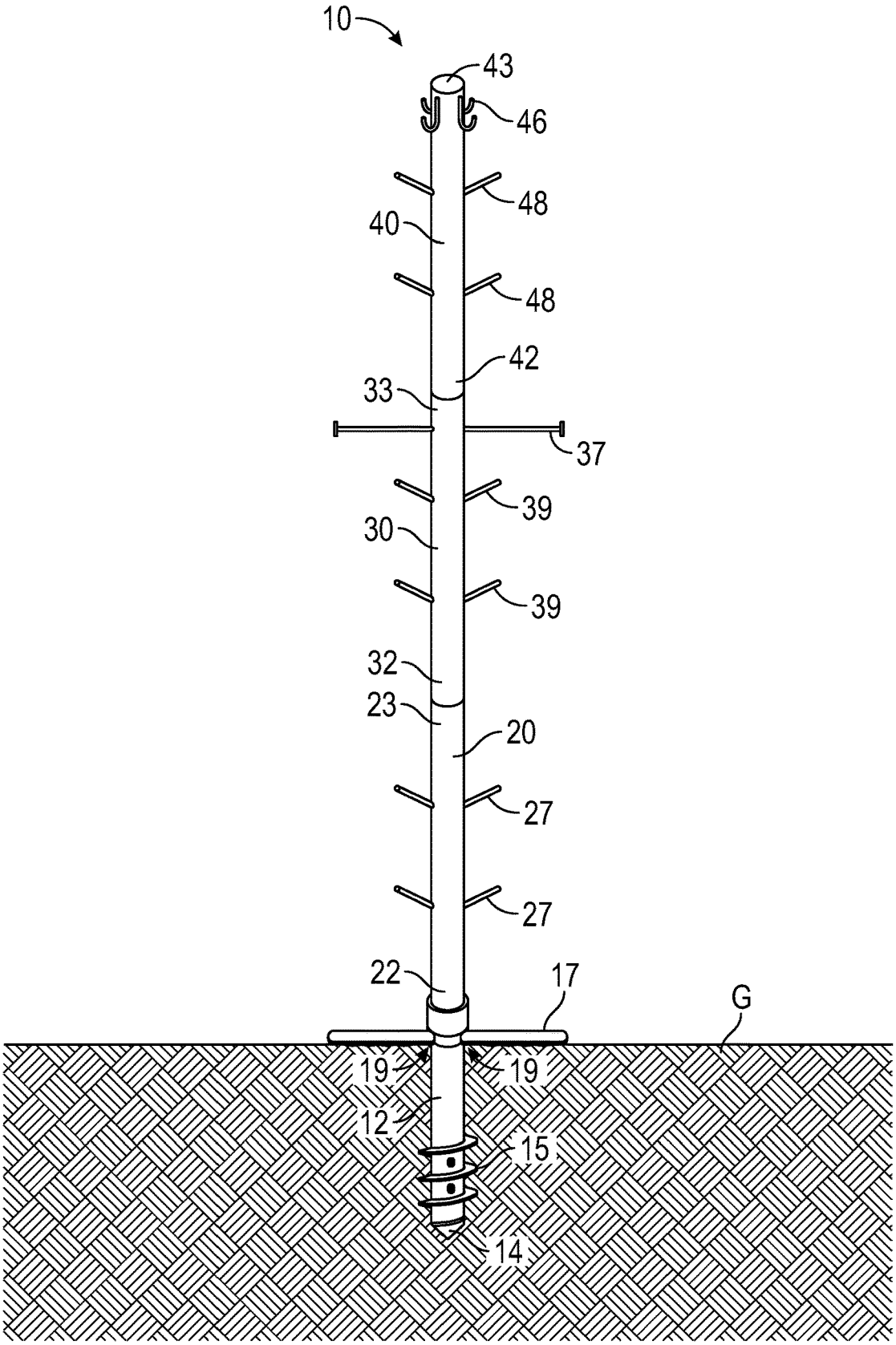
FIG. 3 illustrates the support stand 10 placed in a sand environment.

Now referring to FIG. 3, mounting of the support stand 10 in a sand environment such as a sand environment G, is shown. In order to erect the support stand 10 in the beach, a user of the support stand 10 may position the elongated tube 12 in which the tapered section 14 is made to face the sand/beach. Subsequently, the user may apply pressure using the support plate 17 such that the tapered section 14 is made to go into the sand. Alternatively, the user may twist the support plate 17 in order to insert the elongated tube 12 into the sand environment G. When the user twists the support plate 17, it engages the elongated tube 12 and the threaded portion 15 allows the elongated tube 12 to smoothly enter the sand environment G. After mounting the elongated tube 12 at desired height, the user may mount the first post 20 to the elongated tube 12 by inserting the first end 22 of the first post 20 in the opening 13 of the elongated tube 12. Subsequently, the user may insert the second post 30 into the first post 20, as explained above. Further, the user may insert the third post 40 into the second post 30. Furthermore, first end 22 is longer in length than third end 32 and fifth end 42. The increased length of first end 22 allows for first post 20 to be mounted securely to said opening 13 of said elongated tube 12.

After erecting the support stand 10, the user may hang articles such as clothing articles and other equipment that the user might be carrying to one of the first arms 27, the post extensions 37, the second arms 39, the hook members 46 and the third arms 48 depending on the size of the articles, direction of wind, or as may be desired by a user of the support stand 10.

Figure 4:
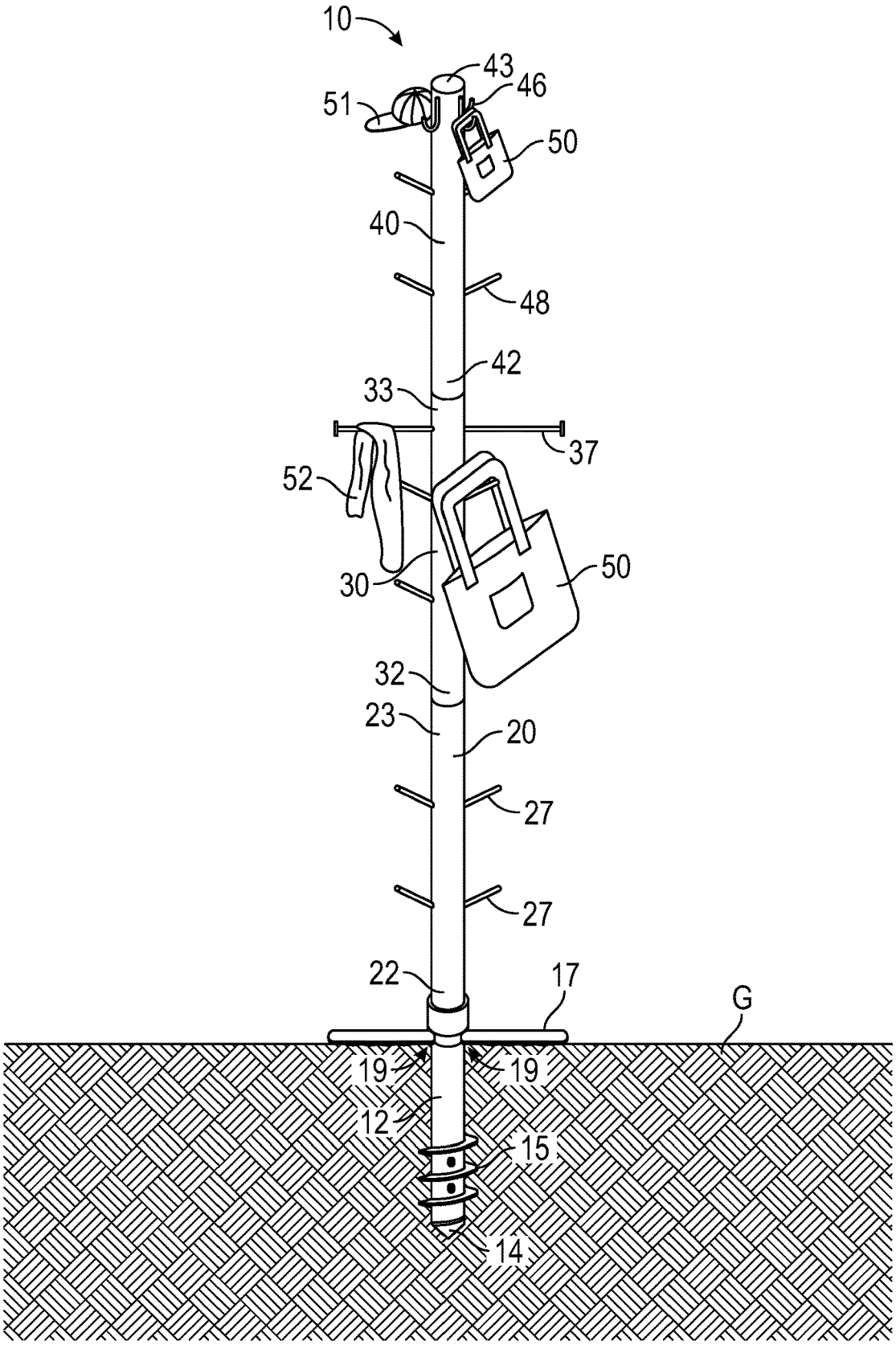
FIG. 4 illustrates a perspective view of the support stand 10 holding articles such as bags 50, caps 51, and towels 52, in accordance with another embodiment of the present invention.

Now referring to FIG. 4, the support stand 10 holding articles is shown, in accordance with one embodiment of the present invention. In one example, articles e.g., clothing articles such as bags 50, caps 51, towels 52 among other articles that are used outdoors during picnics can be mounted to the support stand 10. FIG. 4 is shown to illustrate that the bags 50 might be made to hang to the hook members 46 and/or the second arms 39. Further, the cap 51 is made to hang to the hook members 46. Furthermore, the towel 52 is made to hang at the post extensions 37 provided at the second post 30. It should be understood that FIG. 4 is provided for illustrative purpose only, a person skilled in the art will appreciate that articles other than the above, such as beachwear, swimwear, clothes, sunglasses and other articles might be hanged to one of the first arms 27, the post extensions 37, the second arms 39, the hook members 46 and the third arms 48 depending on the size of the articles, direction of wind, or as may be desired by a user of the support stand 10.

It should be understood that the user might assemble the support stand 10 and then erect the support stand 10 in the sand. Alternatively, the user may insert the elongated tube 12 into the sand environment G and then assemble the first post 20, the second post 30, and the third post 40 as explained above.

After use, the user may demount the first post 20, the second post 30, the third post 40 and the elongated tube 12 to carry them from one place to another.

Based on the above, it should be understood that the support stand explained can be used on flat surfaces or at beaches with the help of the tapered section for holding articles, including but not limited to, beach bags, purse, toys, towels, clothes, etc. As the base support, the first post and the second post are easy to install and uninstall, the support stand helps the user to save time and effort.

Although it is explained that the post extensions are provided at the second post, and the hook members and the third arms are provided at the third post, a person skilled in the art will understand they can be provided interchangeably either at the first post, the second post and the third post to hang variety of articles of different shapes and sizes.

Further, inserting the second post into the first post, and inserting the third post into the first post can adjust the height of the support stand. As such, a support stand can be used at different places such as pool, beach and so on. Additionally, the articles that take up large space such as towel and purse can be hanged to the hook members, which are provided at far end of the second post i.e., far away from the ground. As a result, the articles can be kept clean.

It should be understood that the terminology used herein such as post might also mean pole, pipe, tube and so on. Further, the terms such as first, second, third are used to differentiate components that are similar in nature but are used differently.

It should be understood that the drawings shown herein are provided for illustrative purpose only, and shape and size of each components illustrated should not be construed in limited sense. A person skilled in the art will appreciate that components may be added or deleted to incorporate additional features described in the present disclosure and even such disclosures will be within the scope of the present disclosure.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A support stand for hanging articles, comprising:

an elongated tube including a threaded portion, said elongated tube having a neck portion and a threaded portion, wherein said neck portion is located above said threaded portion, wherein said threaded portion includes two openings located in between said threaded portion, wherein said threaded portion includes a conical bottom end, said neck portion including support plates perpendicularly mounted into a recessed upper portion through means of hinges, wherein said elongated tube is inserted into a sand environment such that said support plates are in contact with a top end of said sand environment;

a first post including a first end and a second end mounted to the elongated tube, wherein the first post includes first arms mounted diagonally to the first post, wherein said first end is a cylindrical member having a diameter, wherein said diameter is less than said first post, wherein said first end further includes first post ridges, wherein said first post ridges includes a first vertical rectangular opening, wherein said first vertical rectangular opening extends the entire height of said first end;

a second post including a third end and a fourth end insertable in the first post, wherein the second post includes post extensions mounted perpendicularly to the second post, the second post further having second arms mounted diagonally to the second post, said post extensions being an elongated horizontal member having a vertical member located on a distal end, wherein said vertical member extends above and below said elongated horizontal member, said post extensions extending beyond said second arms, wherein said third end is a cylindrical member having a diameter, wherein said diameter is less than said second post, wherein said second end further includes second post ridges, wherein said first post ridges includes a second vertical rectangular opening, wherein said second vertical rectangular opening extends the entire height of said third end, said third end being inserted into a second end opening of said first post such that an outer portion of said first post remains flush with an outer portion of said second post; and a third post including a fifth end and a sixth end insertable in the second post, wherein the third post includes hook members mounted perpendicularly to the third post, said hook members located below a top edge of said sixth end, and third arms mounted diagonally to the third post, and wherein articles are made to hold at one of the first arms, the post extensions, the second arms, the hook members and the third arms, wherein said fifth end is a cylindrical member having a diameter, wherein said diameter is less than said third post, wherein said fifth end further includes third post ridges, wherein said third post ridges includes a third vertical rectangular opening, wherein said third vertical rectangular opening extends the entire height of said fifth end, said fifth end being inserted into a fourth end opening of said second post such that an outer portion of said second post remains flush with an outer portion of said third post, wherein said first end includes a height being greater than a height of said third and said sixth end to securely fit within said elongated tube, said sixth end including a flat circular top end.

2. The support stand of claim 1 wherein the first arms are removably mounted to the first post.

3. The support stand of claim 1 wherein the post extensions and the second arms are removably mounted to the second post.

4. The support stand of claim 1 wherein the hook members and the third arms are removably mounted to the third post.

5. The support stand of claim 1 wherein bags, caps, and towels are mounted to said support stand.

6. A support stand for hanging articles, comprising:

an elongated tube including a threaded portion, said elongated tube having a neck portion and a threaded portion, wherein said neck portion is located above said threaded portion, wherein said threaded portion includes two openings located in between said threaded portion, wherein said threaded portion includes a conical bottom end, said neck portion including support plates perpendicularly mounted into a recessed upper portion through means of hinges, wherein said elongated tube is inserted into a sand environment such that said support plates are in contact with a top end of said sand environment;

a first post including a first end and a second end mounted to the elongated tube, wherein the first post includes first arms mounted diagonally to the first post, wherein the first arms are removably mounted to said first post, said first post further includes first ridges to be mounted into said opening of said elongated tube;

a second post including a third end and a fourth end insertable in the first post, wherein the second post includes post extensions mounted perpendicularly to the second post, the second post further having second arms mounted diagonally to the second post, wherein said post extensions and said second arms are removably mounted to said second post, said second post further includes second ridges to be mounted onto said first post; and a third post including a fifth end and a sixth end insertable in the second post, wherein the third post includes hook members mounted perpendicularly to the third post, and third arms mounted diagonally to the third post, wherein the elongated tube is inserted in a sand environment, and wherein articles are made to hold at one of the first arms, the post extensions, the second arms, the hook members and the third arms, said third post further including third ridges to be mounted onto said second post, said support stand adapted to hang bags, caps, and towels.

* * * * *